US005088854A

United States Patent [19]

Sovik

[11] Patent Number: 5,088,854

[45] Date of Patent: Feb. 18, 1992

[54] PAVING JOINTS

[75] Inventor: Robert A. Sovik, Clifton Park, N.Y.

[73] Assignee: AW-2R, Inc., N.Y.

[21] Appl. No.: 565,972

[22] Filed: Aug. 13, 1990

[51] Int. Cl.[5] ..... E01C 3/06; E01C 11/24; E01C 23/02; E01C 19/24

[52] U.S. Cl. ..... 404/72; 404/107; 404/87; 404/96

[58] Field of Search ..... 404/47, 87, 107, 96, 404/102, 72

[56] References Cited

U.S. PATENT DOCUMENTS

| | | | |
|---|---|---|---|
| 3,970,405 | 7/1976 | Swisher, Jr. et al. | 404/105 |
| 4,586,889 | 5/1986 | Krohne et al. | 404/96 |
| 4,657,430 | 4/1987 | Marionneaux | 404/74 |
| 4,869,618 | 9/1989 | Morrison | 404/120 X |
| 5,026,205 | 6/1991 | Gorski et al. | 404/91 X |

*Primary Examiner*—Ramon S. Britts
*Assistant Examiner*—Nancy Connolly
*Attorney, Agent, or Firm*—Joseph V. Claeys; Joseph C. Sullivan

[57] ABSTRACT

Discloses apparatus and methods for providing a longitudinal joint between a cold (previously laid) and a hot (freshly laid) mat of paving material, such as asphalt, and wherein after the rolling of the paving material the joint region between the cold and the hot mats is of a high and substantially uniform density. To this end, there is provided a quantity of additional fresh (hot) paving material formed into a shaped charge and disposed adjacent the edge of the cold mat section. The quantity of additional fresh paving material contained in the shaped charge and the configuration of the shaped charge are made such that after appropriate rolling of the paving material, the lateral and transverse compaction forces generated force sufficient fresh paving material into the joint region between the cold and hot mat sections to bring the density of the paving material in such joint region to substantially the specified density and substantially the same as that of the cold and hot mat sections. That is, the final resulting density of the entire paved area comprising the two mat sections and the longitudinal join therebetween is substantially uniform.

22 Claims, 4 Drawing Sheets

PAVING JOINTS

BACKGROUND OF THE INVENTION a. Field of the Invention

This invention relates generally to the paving of roads, airport runways, parking lots, and the like, and more particularly to new and improved apparatus and methods which can be employed on conventional paver finisher apparatus for making long life, fully compacted, high density longitudinal joints between first and second adjacent mat sections of paving material, such as asphalt paving material.

b. Background of the Invention

One of the major problems in asphalt paving, either overlay or for a new roadway, is obtaining sufficient density and a good seal at the joint between the adjacent passes of paving material in order to provide a long life longitudinal joint. A generally satisfactory, long life longitudinal joint can be produced by operating two pavers working simultaneously. When doing this the lead paver usually runs 50 to 100 feet ahead of the other. The following paver matches the joint of the lead paver before the roller compacts the joint. A good quality joint results because both mat sections are fused together while both mat sections are still hot when rolled.

There has been a serious and continuing problem in obtaining a long life, longitudinal joint between a first mat section of previously laid, rolled and compacted paving material (a cold mat section), and a second mat section of newly laid, fresh and hot paving material (a hot mat section). Since the edge of the first, earlier laid mat section is not restrained during rolling of the first mat section, paving material falls from the side and forms an edge region which angles downwards, generally at an angle of about 45 degrees, and is of lower density than the balance of the rolled and compacted material of such first mat section. Prior attempts to form a long life longitudinal joint between the previously laid cold mat section and the newly laid hot mat section of fresh paving material have heretofore not been entirely successful.

The most commonly used method of paving adjacent lanes, is to use a single paver finisher machine. When a single paver lays both mats sections, the first mat section is laid and then rolled to compact the paving material. When the second mat section is laid adjacent the first mat section, there has usually been sufficient passage of time that the material of the first mat section is cold and there is no longer the desirable fusing together of hot paving materials to form the joint such as when two paver finisher machines are operating simultaneously.

In accordance with this commonly used method, a first pass is made with the paver finisher machine to lay the first lane. This first lane is then rolled to compact the paving material thereof. The second lane, or mat section, is then laid with the paver finisher machine being accurately steered to match the second pass to the first rolled and compacted lane sometimes with an desired overlap. When the second mat section is laid adjacent a first mat section which has been rolled and compacted and which has cooled (cold mat section), this overlap must be removed prior to the rolling to compact the paving material of the second mat section. The depth of the new mat section must be such that subsequent compaction with the roller will bring the new mat section down to the level of the existing first rolled mat section.

Even when very carefully laid, the longitudinal joint so produced between the two adjacent lanes is not entirely satisfactory. Inadequate compaction of the joint is a common cause of joint failure. Often, handwork is required to complete the joint, which is costly, time consuming, and dangerous to the workers, and still fails to produce an entirely satisfactory high density joint.

Examples of some other prior methods, none of which have produced an entirely satisfactory longitudinal joint with a previously laid and rolled cold mat section, are: (1)pre-heating the low density edge region of the cold mat section just prior to the laying of the new mat section of fresh hot paving material, and (2) cutting away the sloping, low density edge region of the cold mat section to form a vertical or undercut edge surface prior to laying the new mat of fresh paving material adjacent the cold mat section. Another prior art method which also fails to produce an entirely satisfactory long life, high density joint, is shown in U.S. Pat. No. 4,181,449. The apparatus and method of U.S. Pat. No. 4,181,449 involves forming a tapered joint between the two adjacent asphalt mat sections formed by two wedge shaped, compacted overlying layers. Such tapered joints are prone to separation and raveling and consequent shorter than desired life.

OBJECTIVES AND SUMMARY OF THE INVENTION

It is a primary object of this invention to provide an apparatus and method for producing a longitudinal joint between a cold and a hot mat section of paving material which overcomes one or more of the foregoing prior art problems and produces a joint having a density which is substantially the same as that of the adjacent mat sections.

It is another object of this invention to provide a longitudinal joint between first and second mat sections of paving material which has a density substantially the same as that of the material in the rolled and compacted first and second mat sections.

It is still another object of this invention to provide an apparatus for use with conventional paving apparatus for establishing a long life, full density compacted, substantially fused longitudinal joint between first and second mat sections of paving material.

It is further object of this invention to provide a new and improved method of forming a long life, full density compacted, substantially fused longitudinal joint between the sloping, lower density edge region of a first cold mat section of previously laid and rolled paving material, and a second mat section of fresh paving material laid adjacent the first mat section.

Briefly stated, in accordance with the broad aspects of this invention there is provided an apparatus and method for providing a longitudinal joint between a first mat section of previously laid and rolled paving material, and a second mat section of fresh paving material laid adjacent the first mat section, and wherein after rolling thereof the paving material of the first and second mat sections and the joint region therebetween all exhibit a substantially uniform density. To this end, the second mat section is provided with a quantity of additional fresh paving material formed into a shaped charge and disposed near the edge of the second mat second which is to be located adjacent the edge of the first mat section. The quantity of additional paving material contained in the shaped charge and the configuration of the shaped charge are made such that after rolling, the lateral and transverse compaction forces generated force sufficient fresh paving material into the joint region to bring the density of the paving material in such joint region to substantially the specified density and substantially the same as that of the first and second mat sections. That is, the resulting density of the entire paved area comprising the two mat sections and the longitudinal joint therebetween is substantially uniform.

In accordance with another aspect of this invention there is provided an apparatus and method for providing a long life, full density compacted, substantially fused, longitudinal joint between a first cold mat section of previously laid, rolled and compacted paving material, and a second mat section of fresh, hot paving material laid adjacent the first mat section. The second mat section of fresh, hot paving material is provided with a shaped charge region containing a desired quantity of additional fresh, hot paving material and having a desired shape and profile. This shaped charge region is located on the second mat sectionof fresh, hot paving material near a first edge thereof. This first edge is the edge which is to be disposed adjacent the edge of the first mat section when the second mat section of fresh, hot paving material is laid. The shaped charge region has a profile which commences near such first edge of the second mat section, rises at an angle in a direction toward the center of the second mat section to a summit, and then angles downwards to a blending point with the top, unrolled surface of the fresh paving material of such second mat section. The summit of the shaped charge region is arranged to be nearer the first edge of such second mat section of fresh paving material than it is to the blending point. That is, the summit is biased in the direction of the first edge. The configuration of the shaped charge region is such, and there is a sufficient quantity of additional fresh paving material contained in the shaped charge, so that when the second mat section of fresh, hot paving material and the shaped charge region thereof are rolled, lateral and transverse forces are generated which cause compaction of the lower density cold edge region of the first mat section to a density substantially the same as that of the first mat section, and with any excess fresh, hot paving material being vented away from the joint and into the second mat section of fresh hot paving material whereby the density of the two adjacent mat sections and the longitudinal joint region therebetween is substantially uniform. Since any excess paving material is vented away from the joint and into the fresh paving material of the second mat section, will be no excess paving material at the joint to form an unacceptable ridge or bump.

BRIEF DESCRIPTION OF THE DRAWINGS

The novel features which I believe characteristic of the invention are set forth with particularity in the appended claims. The invention itself, however, together with further objects and advantages thereof, may best be understood by reference to the following detailed description together with the accompanying drawings wherein:

DETAILED DESCRIPTION OF THE INVENTION

The invention may be employed with any conventional paver finisher machines, such as for example, asphalt pavers of the type shown in U.S. Pat. Nos. 3,236,163 and 3,584,547. Briefly, such paver finisher machines comprise two basic units, a tractor unit and a screed assembly. The primary functions of the tractor are to receive, deliver and spread the paving material in front of the screed. The screed is the mat producing assembly of the paver finisher machine and its primary functions are to level, smooth and seal the surface ready for compaction by rolling.

Figure 1:
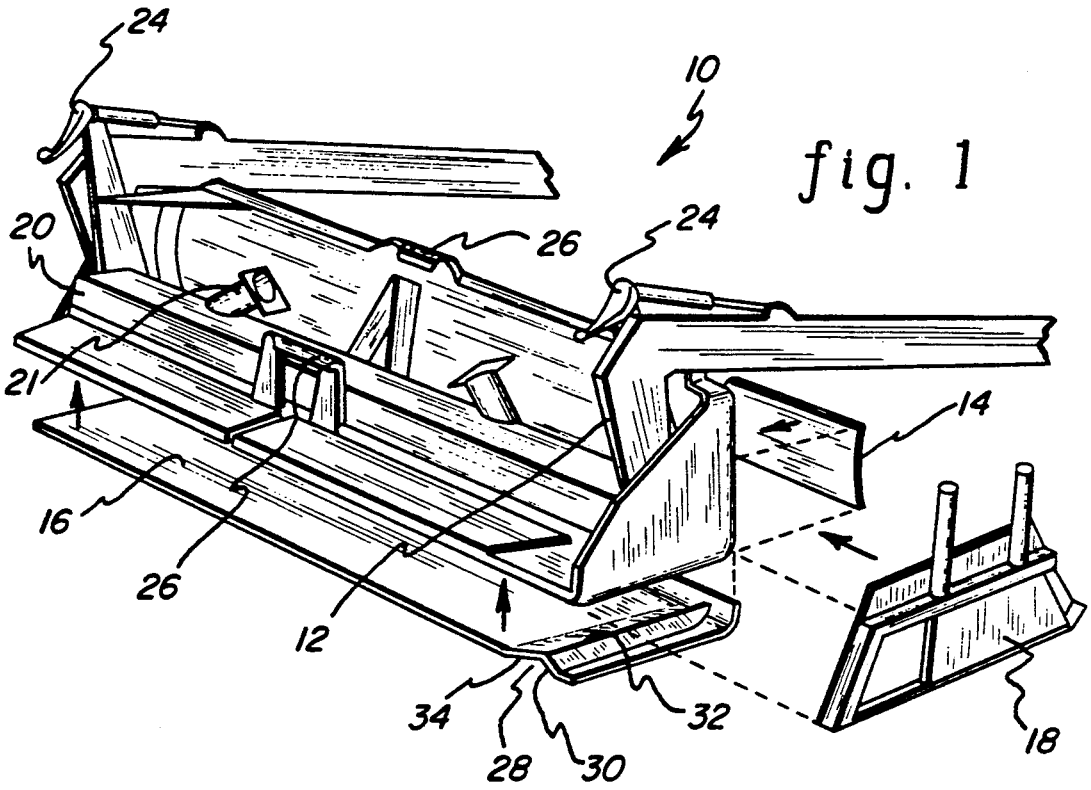
FIG. 1 is an exploded perspective view of a screed assembly of a conventional type of paver finisher machine incorporating a screed plate having a jointer section in accordance with one embodiment of this invention.

Referring now to the drawings, there is shown in FIG. 1 an exploded perspective view of a screed assembly 10 of a conventional type of paver finisher machine. The functions of the screed assembly 10 are to level, smooth and seal the surface of the paving material as the screed assembly is towed forward by the tractor unit (not shown) of the paver finisher machine. As is well known, the screed assembly controls the depth, width, contour and the unrolled texture of the mat section.

To provide for variable extended width paving, the paver finisher machines are often provided with laterally movable screed extension units (FIG. 3), sometimes referred to as "extensible screed/wing sections". As is well known, these screed extension units are attached to the ends of the main screed.

A conventional screed assembly comprises a screed frame 12 to which are attached a pre-strike-off shield 14 and a screed plate 16. The pre-strike-off shield 14 pushes, rolls and meters paving material along its lower edge, similar to a grader blade. The screed plate 16 is the bottom plate which smooths and irons the surface of the mat section. Also included are edger plates 18 disposed a opposite ends of the screed plate 16 and which function to stop or meter paving material passage at the ends of the screed. The screed frame 12 also usually carries vibrators 20, screed heaters 21, screed depth cranks 24, and crowning stations 26 which permit transitions in slope to be made at the specified locations across the mat section.

In accordance with this invention one end of the screed plate 16 has a suitable channel or cavity, designated generally at 28, formed therein which functions to provide for the laying of a region of additional paving material near one edge of the mat section and to form this additional paving material into a "shaped charge" having a desired configuration or profile. Channel 28 comprises a first side wall 30 which commences near one end of the screed plate 16, and angles upwards at an angle of less than 90 degrees to a high point, or summit 32. Preferably, the side wall 30 angles upwards at an angle not greater than 30 degrees. The channel 28 is completed by the opposite side wall 34 which angles downwards from the summit 32 and blends smoothly with the bottom surface of the screed plate 16. Channel 28 is arranged and constructed to have a size and shape so that when the new mat section of fresh, hot paving material is laid adjacent the previously laid and rolled cold mat section, this shaped charge region formed by the channel 28 will be disposed near the adjacent, mating edges of the two mat sections and will supply the required additional paving material and provide for the generation of lateral and transverse compacting forces during rolling to produce a high density longitudinal joint between the two adjacent mat sections. The particular shape and size of channel 28 to achieve the foregoing result is determined by the quantity of the additional paving material calculated to be required in the shaped charge region and the configuration or profile of such shaped charge region. The general criteria for determining the quantity of additional paving material to be contained in the shaped charge region and the configuration or profile of the shaped charge region, and thus the size and shape of cavity 28, will be described in more detail with reference to FIG. 2.

Figure 3:
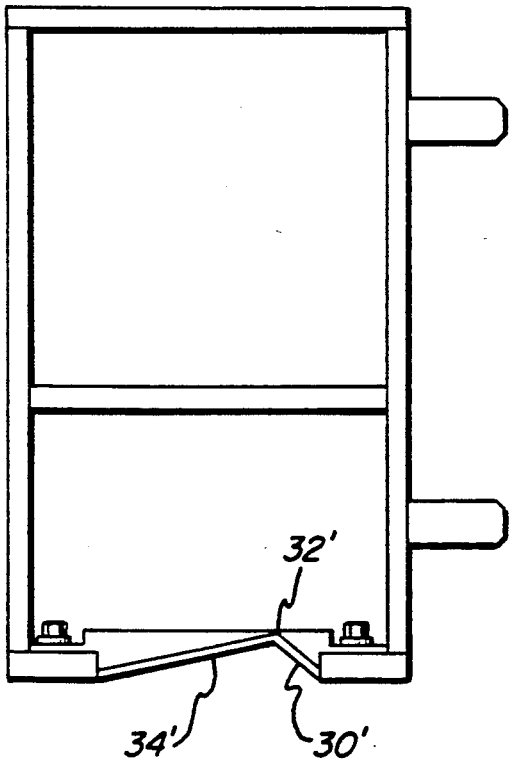
FIG. 3 is a simplified front outline view of the screed extension unit of a conventional type of paver finisher machine incorporating a screed plate constructed in accordance with this invention.

In FIG. 1 the channel 28 is shown formed at one end of the main screed plate 16. The channel 28, however, can be conveniently provided in the screed plate of an extendible screed/wing section of the paver finisher machine as illustrated in FIG. 3. Extensible screed/wing sections are a readily available option for various models of paver finisher machines, such as, for example, the Paver Finisher Models PF-180H and PF-500 manufactured and sold by the Blaw-Knox Construction Equipment Co., East Route 16, Mattoon, Ill. What is required in accordance with this invention is that there be provided a shaped charge region of sufficient additional fresh paving material and that the profile thereof be such that when rolled the additional paving material is forced into the edge region of the previously laid cold mat section to produce a high density joint between the two mat sections. Accordingly the particular means for forming the shaped charge region and its incorporation with the paver finisher machine can be implemented by a wide range of different designs of apparatus.

Figure 2:
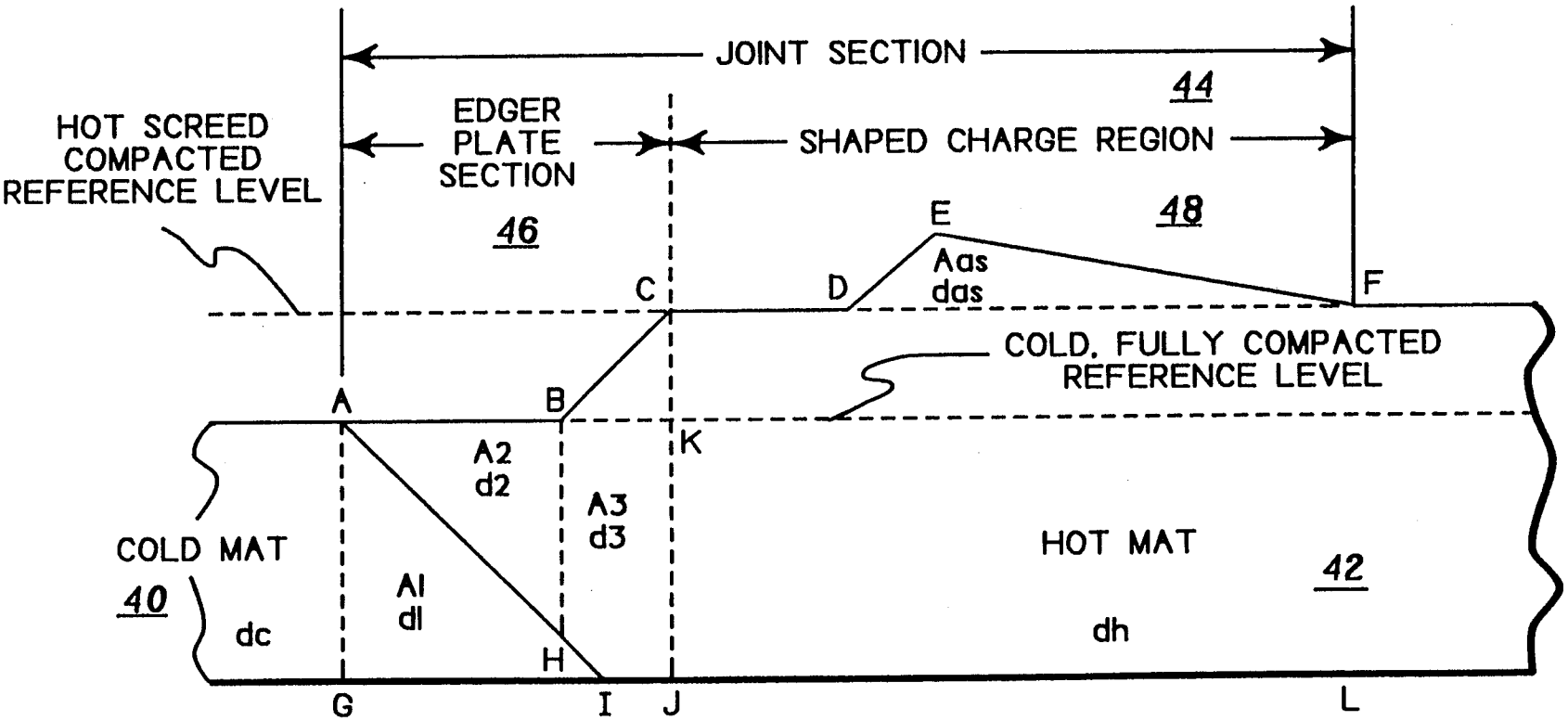
FIG. 2 is a diagrammatic section view illustrating first and second adjacent mat sections of a paving area and showing the profile of the first mat section of rolled and compacted paving material(cold mat section); the profile of the adjacent second mat section of freshly laid and unrolled fresh paving material(hot mat section); and the profiles of the joint section and the shaped charge region of the second mat section in accordance with the teachings of this invention.

In FIG. 2 there is illustrated a paved area comprising a first, cold mat section 40 of previously laid and rolled paving material, a second hot mat section 42 of fresh paving material, and a joint section 44 between the mat sections 40 and 42. The joint section 44 includes an edger plate section 46 and a shaped charge region 48. FIG. 2 also shows the profile of the cold mat section 40 and the profile of the adjacent hot mat section 42 of freshly laid and unrolled fresh paving material. FIG. 2 also shows the profiles of the edger plate section 46 and of the shaped charge region 48 as part of the newly placed hot mat section 42 which is laid immediately adjacent the previously laid and fully compacted cold mat section 40.

Reference will be made to the dimensions and areas shown in FIG. 2 in describing the profile of the joint section 44 and more particularly the profile of the shaped charge region 48 thereof and the determination of the required quantity of additional paving material to be contained in shaped charge region 48 and consequently the range of sizes and shapes of the cavity 28 which may be employed. The dimensions and areas are described with respect to mat sections having a thickness of 2 inches. As will be shown later, however, the changing of the size of the screed plate cavity to produce the required shaped charge region will be straightforward for mat sections having increased or decreased thickness. Moreover, if a proper rolling pattern is employed, a given shaped charge producing screed plate in accordance with this invention can be used to provide a satisfactory, high density, long life joint for mat sections which range in thickness from 2 inches to 6 inches.

As shown in FIG. 2, the line segment AI illustrates the interface between the cold mat section 40 and the hot mat section 42. Cold mat section 40 is shown as having been rolled to achieve a fully compacted density designated dc. All terms used in this description are based on a unit of length of mat section of prescribed width. Therefore, the units of density will be weight per volume per unit length of mat section.

After the rolling operation, substantially all of the cold mat section 40 attains the fully compacted density dc. The exception is at the edge region of the cold mat section 40, since the edge region is not restrained during the rolling operation. This lower density edge region is represented by the triangle AIG. The density of this edge region AIG is not as high as that of the cold mat section 40, but it is higher than that of the unrolled hot mat section 42, which density is designated as dh. The area of the edge region defined by the triangle AIG is designated IG and its density is d1 as shown in FIG. 2

As previously described, the most commonly used method of paving adjacent lanes of a highway or the like, is to use a single paver finisher machine. When a single paver lays both mat sections, the first mat section is laid and then rolled to compact the paving material. In accordance with this commonly used method, a first pass is made with the paver finisher machine to lay the first lane. This first lane or mat section is then rolled to compact the paving material thereof. In the typical situation this first mat section is usually cold by the time the second lane or mat section is ready to be laid. The second mat section, is then laid with the paver finisher machine being accurately steered to match the second pass to the first rolled and compacted mat section. The edger plates 18 stop the passage of paving material at the ends of the screed plate 16 and prevent any of the paving material from being placed on top of the rolled surface of the first cold mat section 40. The depth of the new hot mat section 42 must be such that subsequent compaction with the roller will bring the new mat section 42 down to the level of the existing rolled and compacted cold mat section 40. This level is shown in FIG. 2 as the cold, fully compacted reference level.

The edger plate section profile is depicted by the segment ABC. The region defined by the triangle ABH has area A2 and a density d2. This is the lower density region between the cold mat section 40 and the screed compacted, hot mat section 42 extending to the right of segment CJ. The polygonal region BCJIH adjacent A2 is a low density region which provides for the transition from the reference level AB of the cold mat section 40 to the reference level CF of the hot, screed compacted mat section 42. The polygonal area BCJIH is designated as A3 in FIG. 2 and has a density d3. The polygonal region ABCJIG is shaped and controlled by the profile of the edger plate 18 and is designated in FIG. 2 as the edger plate section 42.

The three areas identified as IG, A2, and A3 once laid must be suitably rolled and compacted with the hot mat section 42 to complete the paving process and formation of the longitudinal joint. In accordance with existing practice, because of the nonuniform sections and areas in the edger plate section 46, the same full compaction density, dc, cannot be attained.

In accordance with this invention, I have discovered that additional fresh paving material must be provided in this joint area and such additional paving material must be suitably shaped and located on the new hot mat section in order to obtain the desired high and substantially uniform compaction density. The amount of additional paving material and its screed compacted profile are both important to the successful creation of a long life, substantially fused, fully compacted joint between the cold and the hot mat sections in the paving process.

The first step in determining the profile of the shaped charge region is to calculate the amount of additional paving material required to attain full compaction density in the edger plate section 46 after completion of the rolling operation. The next step is to determine the shape, or profile of the additional paving material to obtain the desired results The amount of additional paving material can be calculated from the known areas and their densities and the final desired density. The additional material is placed at the joint section, which is designated in FIG. 2 by the triangle DEF, having an area Aas and a density das.

The amount by which the edger plate section 46 is deficient of material to attain its full compaction density, dc, is the sum of the deficiencies from each respective area in the edger plate section 46. The amount of material in the area IG is the product of IG and d1 (IG×d1). When area IG is fully compacted, it will contain the same amount of material but its area will be reduced. If A1c is defined as the area of IG after such area has been fully compacted then, the area A1c is calculated as:

$$A1c = IG(d1/dc) \quad (1)$$

The amount of material by which region IG is deficient of material for the fully compacted density is found by taking the difference between IG abd A1c and multiplying the resultant area by the fully compacted density:

$$(IG - A1c)dc = IG(1 - d1/dc)dc \quad (2)$$

or the deficient material (DM) for area IG is stated by:

$$DM(IG) = IG(dc - d1). \quad (3)$$

This is the amount of material which must be added. However to be of use, the area of the hot, screed compacted density must be determined. This is found by dividing the result of equation (3) by the density of the material that will be laid into the shaped charge region 48 of the joint section. Define Aas1 as the material in the shaped charge region due to area IG, and the density of the material as, das. From these definitions, equation (4) can be written as follows:

$$Aas1 = IG(dc - d1)/das \quad (4)$$

The relationship of equation (4) can be simplified by defining the density ratio, r1, as:

$$r1 = (dc - d1)/das \quad (5)$$

Equation (5) can then be used to simplify equation (4) as follows:

$$Aas1 = IG\ r1 \quad (6)$$

More generally, then, for the ith region, equations (5) and (6) are written as:

$$r1 = (dc - di)/das \quad (7)$$

and $$Aasi = Ai\ ri \quad (8).$$

As previously stated, by summing the deficiencies of each respective area, the total area of the shaped charge region is determined. For the three areas defined with respect to FIG. 2, equation (8) is expanded with specificity to become:

$$Aas = IG\ r1 + A2r2 = A3\ r3 \quad (9).$$

Once the area of the shaped charge region is known, the geometric details of the profile are governed by a force truss analysis to generate the lateral and transverse compaction forces which arise when the shaped charge region is rolled. The generation of these forces is a virtue of the viscoelastic behavior of the paving medium.

The objective of the force analysis is to create compaction forces within the edger plate section 46. These compaction forces will compress the paving material of the edge region of the cold mat section 40 as well as the fresh hot paving material to the full compaction density. The heat transfer across the interface IG, softens the material in the low density edge region, A1, to allow the compaction thereof and the creation of a substantially fused and sealed joint between the cold mat section 40 and the hot mat section 42.

In FIG. 2 the shaped charge region 48 is illustrated in the form of a triangle, but it should be understood that the shaped charge region is not to be limited to such a triangular configuration. The use of the triangular configuration has been used to make the foregoing presentation clear.

The triangle DEF is the shaped charge profile. This truss is configured to produce greater compaction forces near the joint than in the direction toward the center of the hot mat section 42. This is accomplished by biasing the location of the high point or summit, E, of the profile of the shaped charge region 48 toward the mat interface, AI. The angle, DEF, EDF, at the base of the shaped charge region, 48, must be less than 90 degrees to achieve the proper result. Angles less than 90 degrees will generate the desired lateral compaction forces while assuring that none of the fresh, hot paving material is disposed on the top rolled surface of the cold mat section 40. Defining this angle, the area of the shaped charge region 48 and the location of the summit of the shaped charge region suitably biased toward the interface will result in numerous triangles, EDF, which will satisfy the foregoing criteria. Each of these profiles will produce variations in magnitude and direction of the compaction forces and can thereby be optomized depending on the angle, AIG, of the edge region of the cold mat 40 and the densities of the paving material in the various regions of the hot and cold mat sections in the vicinity of the mat interface, AI.

In accordance with the foregoing calculation, a shaped charge producing screed plate in accordance with this invention can be readily fabricated having the specific shape and size of channel to produce the required shaped charge region to produce the required long life, high density joint between the two mat sections. Changing the shape and size of the screed plate channel to meet the requirements of mat sections having different thickness is straightforward in view of the foregoing description. For example, in general, less additional material would be required for a mat section of 1 inch thickness and more additional paving material would be required for a mat section of 3 inch thickness.

While a specific shaped charge producing screed plate in accordance with this invention could be provided for each different thickness of mat section, a given screed plate design having a channel provided in accordance with the foregoing calculation can be used to provide a wholly satisfactory, high density joint for mat sections having a thickness in the range of 1 inch to 3 inches. That is, each screed plate design will handle a range of mat section thicknesses.

In further accord with this invention, it has been discovered that by employing a proper rolling pattern, a given design of shaped charge producing screed plate can be employed to provide long life, high density joints for mat section thicknesses from 1 inch to 6 inches. For example, it is known that during rolling, the mat section of fresh, hot paving material will grow in width approximately ⅛ inch per foot of mat section being rolled. Thus, an unconfined mat section having a width of 8 feet would increase about 1 inch in width during the breakdown rolling. Accordingly, additional fresh paving material is being moved toward the outside edge of the mat section. The amount of paving material that is being moved during this rolling process is a function of the thickness of the mat section and such amount can be calculated for any given mat section thickness.

In accordance with another feature of this invention, therefore, the use of a proper rolling pattern can assure that this growth in mat section width is employed to provide sufficient material at the joint section to produce the desired high density joint between the two mat sections. Thus, with the proper rolling pattern a given design of shaped charge producing screed plate can be used to produce good, high density joints for rolled material section (cold mat) thicknesses from 1 inch to approximately 6 inches. For example, for a mat section thickness of 2 inches or less, rolling should commence at the joint region. That is, the joint section should be rolled first with the roller overlapping the cold mat section by a small amount, such as for example about 6 to 10 inches or so.

Figure 4:
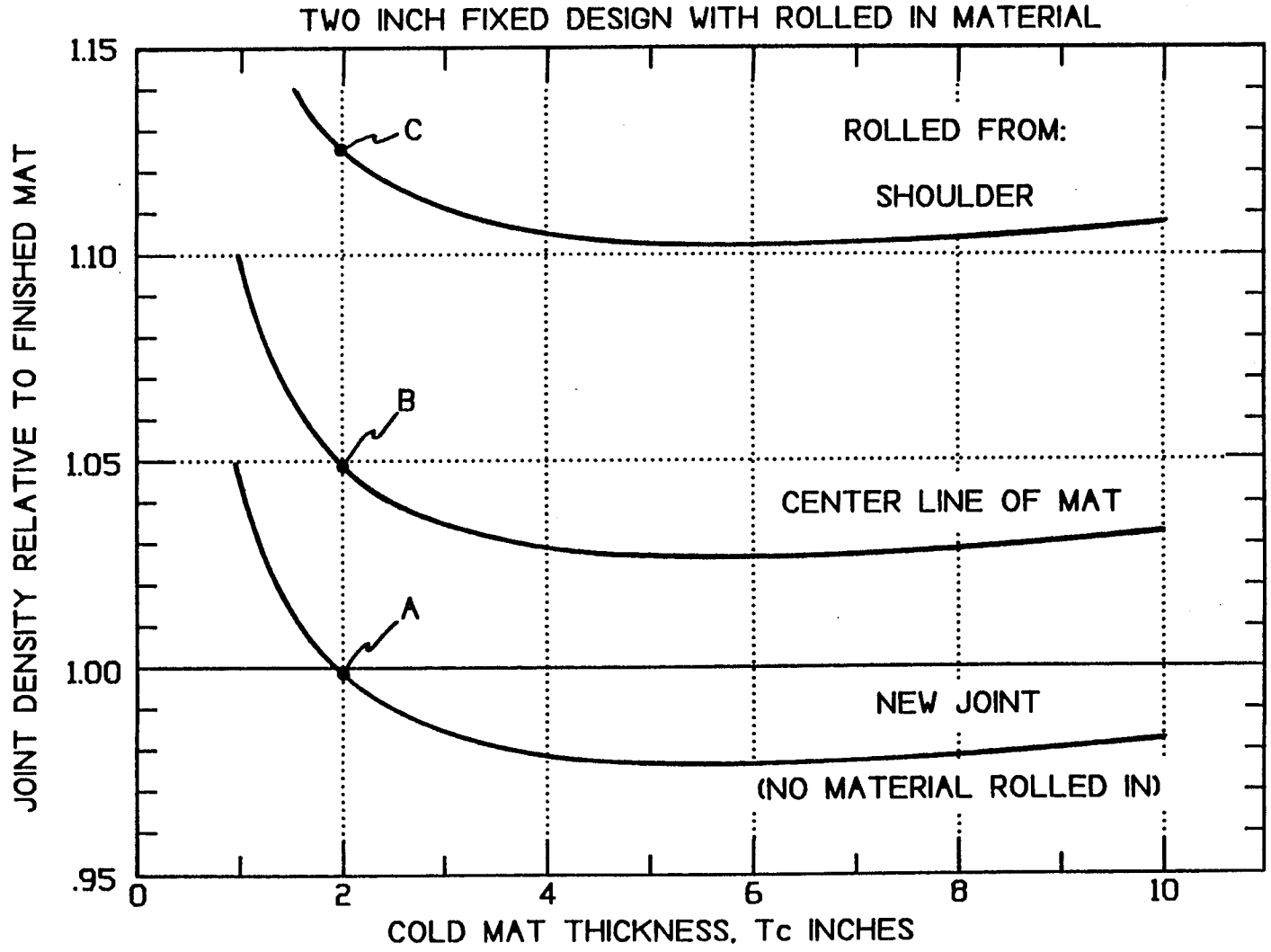
FIG. 4 is a set of curves showing the change in joint density as a function of the rolling pattern for and for different thicknesses of mat.
Figure 5:
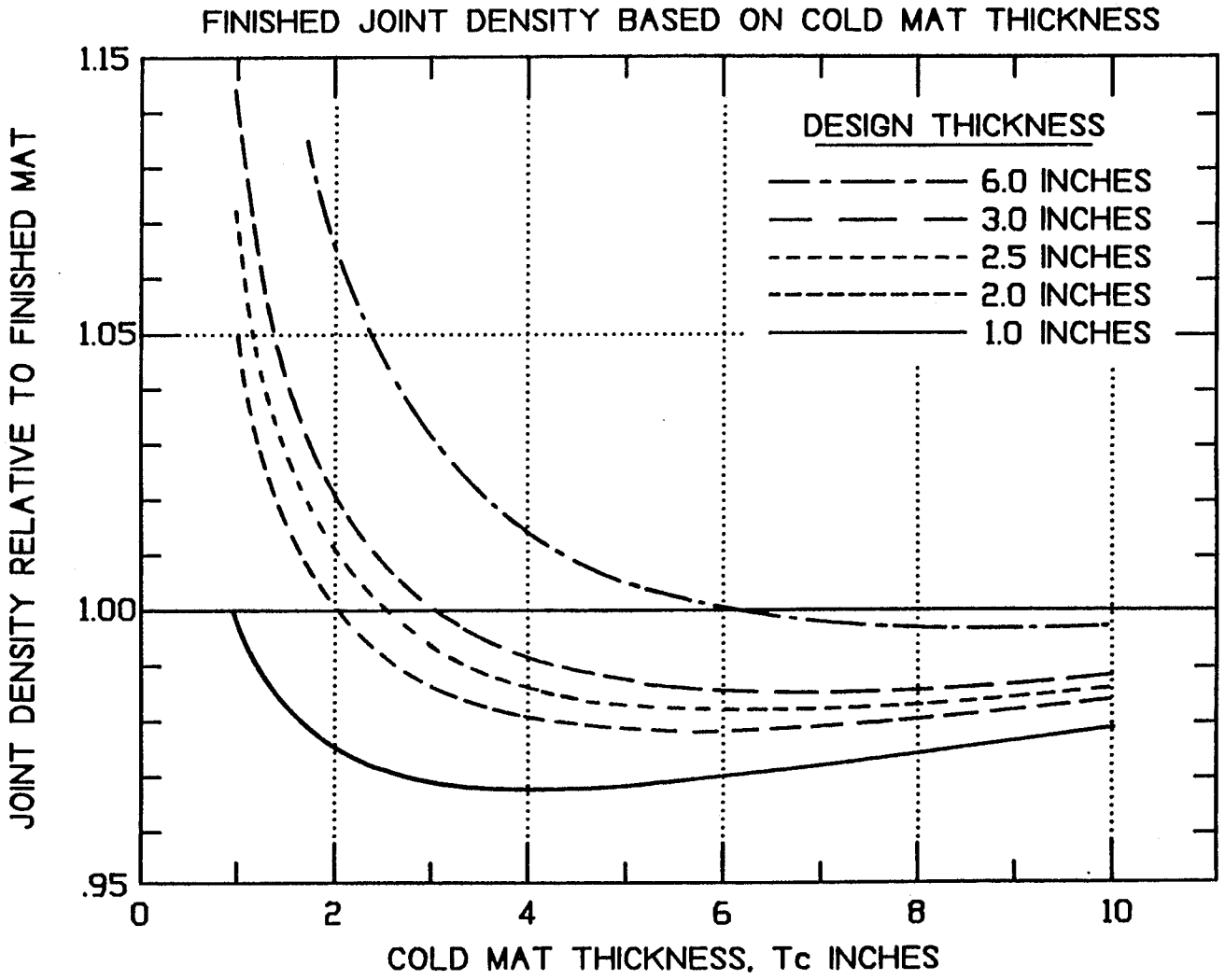
FIG. 5 is another set of curves showing the finished joint density based on the thickness of the cold mat.

The curves in FIG. 4 show the effect of the rolling pattern with respect to different mat section thicknesses and for a given design of shaped charge producing screed plate in accordance with this invention. For example, point A in FIG. 4 is the 100% density (the design density) for a given mat section. If for the same cold mat thickness, the rolling of the hot mat toward the cold mat were to be from the center of the hot mat toward the cold mat, the joint density would be increased to approximately 1.05 of the design density as indicated by the point B in FIG. 4. Further, if the rolling patterncommences at the shoulder edge of the hot mat and proceeds toward the cold mat, the joint density would be increased to approximately 1.13 of the design density as shown by the point C in FIG. 4. This principle can be used to either increase or decrease the density at the design joint section or to achieve the desired density when the cold mat thickness is greater that the design thickness. The curves in FIG. 5 show the variation of finished joint densities for cold mats of different thicknesses.

While there have been described what are at present considered to be the preferred embodiments of this invention, many changes and modifications not departing from the invention will occur to those skilled in the art. It is, therefore, intended in the appended claims to cover all such changes and modifications which come within the true spirit and scope of the invention.

What is claimed is:

1. In a pavement-laying machine adapted to move longitudinally alongside a first mat section of previously laid, rolled and compacted paving material and lay a second mat section of fresh paving material adjacent the edge of said first mat section, means for forming a longitudinal joint between said first and second mat sections, comprising:

means operatively associated with said pavement-laying machine for laying said second mat section of fresh paving material having a shaped charge region of predetermined profile formed thereon and containing additional fresh paving material, one end of the profile of said shaped charge region commencing near the top level of the edge of said first mat section and extending angularly upwardly and away from said top level of the edge of said first mat section and in the direction toward the center of said second mat section for a predetermined distance toward a summit and then angularly extending downwardly from said summit toward a blending point with the top level of the fresh paving material of said second mat section, and the summit of said profile being biased in the direction toward said first mat section whereby when said second mat section and the shaped charge region thereof is rolled, lateral and transverse compaction forces are generated and a full density compacted, substantially fused longitudinal joint is provided between said first and second mat sections and with any excess fresh paving material being vented away from the joint to the fresh paving material of said second mat section.

2. The invention recited in claim 1 wherein the one end of the profile of said shaped charge region entends upwardly and away from the top level of the edge of said first mat section at an angle sufficient to avoid fresh paving material being rolled onto said first mat section of paving material.

3. The invention recited in claim 1 wherein the one end of the profile of said shaped charge region extends upwardly and away from the top level of the edge of said first mat section at an angle less than 90 degrees.

4. The invention recited in claim 2 wherein the one end of the profile of said shaped charge region extends away from the top level of the edge of said first mat section at an angle less than 90 degrees.

5. The invention recited in claim 1 wherein the one end of the profile of said shaped charge region extends upwardly and away from the top level of the edge of said first mat section at an angle of not more than 45 degrees.

6. The invention recited in claim 1 wherein the one end of the profile of said shaped charge region extends upwardly and away from the top level of the edge of said first mat section at an angle of 30 degrees.

7. The invention recited in claim 2 wherein the one end of the profile of said shaped charge region extends upwardly and away from the top level of the edge of said first mat section at an angle of not more than 45 degrees.

8. The invention recited in claim 1 wherein the ratio of the lateral distance from the top level of the edge of said first mat section to said summit of the profile of said shaped charge region to the lateral distance from said summit to the said blending point with the top level of said second mat of fresh paving material is 1:2.

9. The method of forming a longitudinal joint between the edge region of a first mat section of previously laid, rolled and compacted paving material and a second mat section of fresh paving material, comprising:

laying the second mat of fresh paving material adjacent said first mat section, forming on said second mat section a shaped charge region having a predetermined profile and containing a predetermined quantity of additional fresh paving material, one end of the profile of said shaped charge region commencing near the top rolled surface of the edge region of said first mat section and extending upwardly and in the direction of said second mat section at an angle less than 90 degrees for a predetermined distance to a summit and then angularly extending downwardly from said summit to a blending point with the top surface of said second mat section, and rolling said second mat section and the shaped charge region thereof in accordance with a desired rolling pattern whereby fresh paving material of the shaped charge region is forced into said edge region of said first mat section and the material of said edge region is also heated thereby to provide a full density compacted, substantially fused longitudinal joint between said first and second mat sections.

10. The method recited in claim 9 wherein the one end of the profile of said shaped charge region extends upwardly toward said summit at an angle of 45 degrees from the level of the top rolled surface of said first mat section.

11. The method of forming a longitudinal joint between the lower density edge region of a first mat section of previously laid, rolled and compacted paving material and a second mat section of fresh paving material, comprising:

laying the second mat section of fresh paving material with a first edge thereof adjacent said first mat section, forming on said second mat section a shaped charge region commencing near said first edge and containing additional fresh paving material, said shaped charge region having a profile which terminates at one end near said first edge and extends in the direction toward the center of said second mat section at an angle of less than 90 degrees to a summit and angles downwardly from said summit to a blending point with the surface of the second mat section, said summit being biased in the direction of said first edge, and said shaped charge region containing sufficient additional fresh paving material so that when said second mat section and the shaped charge region thereof is rolled, the lower density edge region of said first mat section will be compacted to the selected density and with any excess fresh paving material being vented away from the joint into the said second mat section.

12. The method of claim 11 wherein the one end of the profile of said shaped charge region terminates near said first edge and extends in the direction toward the center of said second mat section at an angle not greater than 45 degrees.

13. The method of claim 11 wherein the one end of the profile of said shaped charge region terminates near said first edge and extends in the direction toward the center of said second mat section at an angle not greater than 30 degrees.

14. The invention recited in claim 11 wherein the ratio of the lateral distance from the top level of said first edge of said second mat section to the summit of the profile of said shaped charge region to the lateral distance from said summit to the said blending point with the top level of said second mat of fresh paving material is 1:2.

15. The method of forming a longitudinal joint between first and second mat sections of paving material, comprising the steps of:

laying a first mat section of paving material, rolling said first mat section to compact the paving material thereof to a specified density, said rolling resulting in a sloping edge region of paving material which is of lower density, laying a second mat section of fresh, hot paving material having one edge thereof adjacent the lower density edge region of said first mat section, and providing at a location near said one edge of said second mat section a shaped charge of additional fresh, hot paving material, said shaped charge containing a sufficient quantity of fresh, hot paving material and formed to have a shape and profile so that when said second mat section and the shaped charge of additional fresh, hot paving material thereof is rolled, lateral and transverse froces are generated and sufficient fresh, hot paving material is forced into the lower density edge region of said first mat section and with any excess paving material being vented to said second mat section to bring said edge region to substantially the same density as that of said first and second rolled mat sections.

16. The method of claim 15 wherein said shaped charge has a shape and profile which terminates at one end near said one edge of said second mat section, rises to a summit at an angle less than 90 degrees and slopes downwardly form said summit to a blending point with the surface of the second mat section and wherein said summit is biased in the direction toward said one edge.

17. The methon of claim 16 wherein the shape and profile of said shaped charge rises to said summit at an angle of not more than 45 degrees.

18. The methon of claim 15 wherein the shape and profile of said shaped charge rises to said summit at an angle of not more than 30 degrees.

19. A screed plate for use with a paver finisher machine, comprising:

a channel disposed near one end of said screed plate and extending continuously from front to back thereof, said channel being defined by a first wall commencing from the bottom surface of said screed plate near said one end and extending upwardly and away from said one end at an angle less than 90 degrees to a summit, and a second wall which extends angularly downwardly from said summit to a blending point with the bottom surface of said screed plate, said summit being nearer said one end than it is to said blending point, said channel being arranged and constructed to lay a shaped charge region containing a predetermined quantity of fresh paving material along the top surface of a mat section of fresh, hot paving material and which shaped charge region is laid down with the paving material of said mat section as said paver finisher machine is moved during a paving pass.

20. The screed plate recited in claim 19 wherein said first wall of said channel extends upwardly at an angle not more than 45 degrees.

21. The screed plate recited in claim 19 wherein said first wall of said channel extends upwardly at an angle not more than 30 degrees.

22. The invention recited in claim 19 wherein the ratio of the lateral distance from said one end to said summit to the lateral distance from said summit to the said blending point is 1:2.

* * * * *